US006641392B2

(12) United States Patent
Siirilä

(10) Patent No.: US 6,641,392 B2
(45) Date of Patent: Nov. 4, 2003

(54) METHOD FOR REGULATING A ROASTING FURNACE

(75) Inventor: Heikki Siirilä , Kokkola (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/204,937

(22) PCT Filed: Mar. 16, 2001

(86) PCT No.: PCT/FI01/00260

§ 371 (c)(1),
(2), (4) Date: Aug. 27, 2002

(87) PCT Pub. No.: WO01/68926

PCT Pub. Date: Sep. 20, 2001

(65) Prior Publication Data

US 2003/0010268 A1 Jan. 16, 2003

(30) Foreign Application Priority Data

Mar. 16, 2000 (FI) ..... 20000608

(51) Int. Cl.[7] ..... F27B 15/10

(52) U.S. Cl. ..... 432/58; 432/14; 75/751

(58) Field of Search ..... 432/14, 15, 58, 432/77, 78; 75/746, 751, 754, 770; 423/47; 110/270, 283, 292, 288

(56) References Cited

U.S. PATENT DOCUMENTS

| | | | | | |
|---|---|---|---|---|---|
| 3,921,307 | A | * | 11/1975 | Marek et al. | 34/363 |
| 4,624,636 | A | * | 11/1986 | Willis | 432/78 |
| 5,759,026 | A | * | 6/1998 | von Wedel | 432/77 |
| 5,803,949 | A | | 9/1998 | Brown et al. | |

* cited by examiner

*Primary Examiner*—Gregory Wilson
(74) *Attorney, Agent, or Firm*—Morgan & Finnegan, LLP

(57) ABSTRACT

The invention relates to a method of regulating a roasting furnace in fluidized bed roasting. Part of the roasting furnace grate is separated off into a separate grate section, known as the overflow grate, where the nozzles and the amount of roasting gas blown through them can be regulated independently of the main grate. It is advantageous to position the separately regulated grate in the section of the furnace where the overflow aperture is located.

14 Claims, No Drawings

METHOD FOR REGULATING A ROASTING FURNACE

BACKGROUND OF THE INVENTION

1. Field of the Invention

The present invention relates to a method of regulating a roasting furnace in fluidized bed roasting. Part of the grate of the roasting furnace is separated into a separate grate section, known as an overflow grate, where the nozzles and the amount of roasting gas blown through them can be regulated independently of the main grate. It is advantageous to position the separately regulated grate in the section of the furnace where the overflow aperture is located.

2. Description of Related Art

The roasting of concentrates such as zinc sulphide concentrate usually takes place using the fluidized bed method. In the roasting process, the material to be roasted, a fine-grained concentrate, is fed into the roasting furnace via the feed units in the wall of the furnace above the fluidized bed. On the bottom of the furnace there is a grate, via which oxygen-containing gas is fed in order to fluidize the concentrate. The grate usually has in the order of 100 gas nozzles/$m^2$. As the concentrate becomes fluidized, the height of the feed bed rises to about half that of the fixed material bed. The height of the bed is on average 8–12% of the total height of the furnace. The pressure drop in the furnace is formed by the resistance of the grate and that of the bed. The resistance of the bed is more of less the mass of the bed when the bed is in a fluidized state. The pressure drop is in the range of 240–280 mbar.

The concentrate in the fluidized bed is oxidized (burnt) to a calcine by the effect of the oxygen-containing gas fed via the grate, e.g. zinc sulphide concentrate is roasted into zinc oxide. In zinc concentrate roasting the temperature to be used is in the region of 900–1050° C. The calcine is partially removed from the furnace through the overflow aperture, and partially it travels with the gases to the waste heat boiler and from there on to the cyclone and electrostatic precipitators, where the calcine is recovered. In general the overflow aperture is located on the opposite side of the furnace to the feed units. The calcine removed from the furnace is cooled and ground finely for leaching.

For good roasting it is important to control the bed, i.e., the bed should be good and the fluidizing controlled. Combustion should be as complete as possible and the calcine should come out of the furnace well. The particle size of the calcine is known to be affected by the chemical composition and mineralogy of the concentrate as well as by the temperature and oxygen enrichment of the roasting gas. Good fluidizing and bed stability can be improved, for example, by regulating the amount of impurities in the concentrate mixture or by adding water to the fine concentrate, causing micropelletization. U.S. Pat. No. 5,803,949 describes the stabilization of a fluidized bed in zinc concentrate roasting, where the bed is stabilized by regulating the particle size distribution of the bed.

The actual pressure drop of the roasting furnace is determined by the particle size and the volume weight of the concentrate in the fluidized bed, the height of the bed in the roasting furnace and the grate structure. In order for the functioning of the roasting furnace to be stable, the pressure drop should remain in a certain position in the furnace. A low pressure drop may be the result of a low bed for example. Thus local hot points may form and sintering may occur.

Conventionally furnace pressure drop and bed height are regulated by adding or removing baffle bars located at the lower edge of the overflow aperture. Pressure drop can also be affected somewhat by the amount of gas fed through the grate, in particular the part caused by the grate itself. Adding and removing baffle bars may come to the limit and on the other hand, handling the bars themselves is not to be recommended for reasons of industrial hygiene.

BRIEF SUMMARY OF THE INVENTION

A method has now been developed according to the present invention allowing roasting furnace conditions to be regulated, when material for roasting is fed above the fluidized bed and the fluidizing roasting gas through the grate at the bottom of the roasting furnace, and at least some of the calcined material is removed from the overflow aperture located at the height of the top of the fluidized bed. Part of the furnace grate is separated off to form a separate section, known as the overflow grate, where the nozzles and amount of gas blown through them are regulated independently of the main grate. The separately regulated grate is located in the same section of the furnace as the calcine overflow aperture, preferably below the overflow aperture. The essential features of the invention will become apparent in the attached patent claims.

It has been shown that using a separately regulated grate the ratio in which the calcine is removed from the furnace via the overflow aperture/boiler can be regulated. Using an overflow grate can affect the increase of favourable particle size. It has been found that an overflow grate can be used to regulate furnace conditions even if there were only less than 0.5% of all the nozzles in the grate in its area. The control range of the pressure drop of the overflow grate itself should preferably be wide, around 200–2500 mbar.

In practice it has been noticed that increasing overflow grate pressure drop increases the amount of calcine removed via the overflow aperture in relation to the amount of calcine recovered from elsewhere. On the other hand the capacity of the furnace can also be raised by routing a larger amount of the calcine via the overflow aperture and this can be achieved precisely by using the overflow grate. Increasing overflow grate pressure drop may affect the turbulence of the fluidized bed, which causes the coarser material in the lower part of the bed to rise upwards and to be discharged from the furnace through the overflow aperture.

The calcine removed from the overflow aperture is cooled preferably in a vortex cooler. It is known in the prior art that the sulphate content of calcine obtained from a boiler is higher than that recovered from a vortex cooler. Calcine containing sulphates can cause blockages in the boiler, so decreasing the amount of calcine obtained from the boiler aids the smooth functioning of the boiler and the whole process.

The invention is described by the following examples:

EXAMPLE 1

A production-scale roasting furnace was run with a constant amount of air (42 000 $Nm^3$) and standard baffle bars with a combined height of 75 mm. The temperature was held constant at 950° C. and the feed mixture was also kept constant. It was possible to regulate the furnace pressure drop by regulating the pressure drop of the overflow grate as shown in the table below:

TABLE 1

| Overflow grate pressure drop mbar | Roasting furnace pressure drop mbar |
|---|---|
| 500 | 263 |
| 1 000 | 254 |
| 1 200 | 249 |

EXAMPLE 2

A roasting furnace as in example 1 was used. Oxygen (500 $Nm^3$) was added to the grate air (44 000 $Nm^3$), whereupon the pressure drop of the furnace began to rise, but it was stabilized by raising the pressure drop of the overflow grate from 800 mbar to 1200 mbar.

What is claimed is:

1. A method for regulating roasting furnace conditions in a roasting furnace having a fluidized bed in which a material for roasting is calcined, comprising feeding the material for roasting into the furnace at a location above the fluidized bed, feeding a fluidizing roasting gas through nozzles within a main grate located at the bottom of the furnace to fluidize the material for roasting, removing from the furnace at least some of the calcined material through an overflow aperture located at the top of the fluidized bed, separating off part of the roasting furnace main grate, within the same section of the furnace that the overflow aperture is located and below the overflow aperture, to form a separate section, an overflow grate, and feeding fluidizing roasting gas through nozzles within the overflow grate at a rate that is independent of the rate that fluidizing roasting gas is fed though the nozzles within the main grate.

2. A method according to claim 1, wherein less than 0.5% of the total nozzles in the main grate are in the overflow grate.

3. A method according to claim 1, wherein the pressure drop of the overflow grate is regulated within the range of 200–2500 mbar.

4. A method according to claim 1, further comprising adjusting the pressure drop of the furnace by regulating the pressure drop of the overflow grate.

5. A method according to claim 4, wherein the pressure drop of the overflow grate is increased to decrease the pressure drop of the roasting furnace.

6. A method according to claim 4, wherein the pressure drop of the overflow grate is increased to stabilize the pressure drop of the roasting furnace.

7. A method according to claim 1, further comprising adjusting the amount of calcine to be removed from the overflow aperture by regulating the pressure drop of the overflow grate.

8. A method according to claim 7, wherein overflow grate pressure drop is increased to increase the amount of calcine removed via the overflow aperture in relation to the amount of calcine recovered from elsewhere.

9. A method according to claim 1, further comprising adjusting the particle size of the fluidized bed by regulating the pressure drop of the overflow grate.

10. A method according to claim 9 wherein overflow grate pressure is increased to increase turbulence of the fluidized bed so that coarser material in a lower part of the fluidized bed rises upwards and is discharged from the furnace through the overflow aperture.

11. A method according to claim 1, wherein the material to be calcined is a concentrate.

12. A method according to claim 11, wherein the material to be calcined is a zinc sulphide concentrate.

13. A method according to claim 12, wherein the zinc sulphide concentrate is calcined into zinc oxide at a roasting temperature between 900° C. and 1050° C.

14. A method according claim 1, wherein the material for roasting is calcined at a roasting temperature between 900° C. and 1050° C.

* * * * *